United States Patent [19]

Beachboard

[11] Patent Number: 4,673,029

[45] Date of Patent: Jun. 16, 1987

[54] ZONED HEATING AND AIR CONDITIONING SYSTEM

[76] Inventor: Stephen A. Beachboard, P.O. Box 16448, Orlando, Fla. 32861

[21] Appl. No.: 638,244

[22] Filed: Aug. 6, 1984

[51] Int. Cl.[4] ..... F24F 3/00; F24F 7/00

[52] U.S. Cl. ..... 165/22; 236/49; 236/1 B; 236/1 C

[58] Field of Search ..... 165/22; 236/49, 1 B, 236/91 E, 1 C

[56] References Cited

U.S. PATENT DOCUMENTS

| | | | |
|---|---|---|---|
| 2,158,628 | 5/1939 | Kuhlman | 236/1 B |
| 2,468,830 | 5/1949 | Markham | 236/1 B |
| 3,127,103 | 3/1964 | Grogan | 236/1 B |
| 3,297,250 | 1/1967 | Capps | 236/1 C |
| 4,185,769 | 1/1980 | Nezworski | 236/1 G |
| 4,277,019 | 7/1981 | Shreve | 165/22 |

*Primary Examiner*—William R. Cline
*Assistant Examiner*—John K. Ford
*Attorney, Agent, or Firm*—William M. Hobby, III

[57] ABSTRACT

A building air conditioning and heating system includes an air handling system set up to separately control different zones of a building. The air handling system has a blower connected to an air duct system in the building. At least two thermostats are positioned in different portions of the building for separately controlling the heating or the air conditioning in that portion of the building. A plurality of dampers are positioned in the air duct system, with each damper adapted to be opened and closed by gravity or air pressure. A damper locking means locks each damper in a closed position responsive to actuation by an electrical switch so that one zone of the building can be air conditioned or heated as desired. The thermostat can acutate the dampers and can control the temperature in one zone portion of the building while the other thermostat is disabled. Each damper has an electrical solenoid for locking the damper in one position.

3 Claims, 9 Drawing Figures

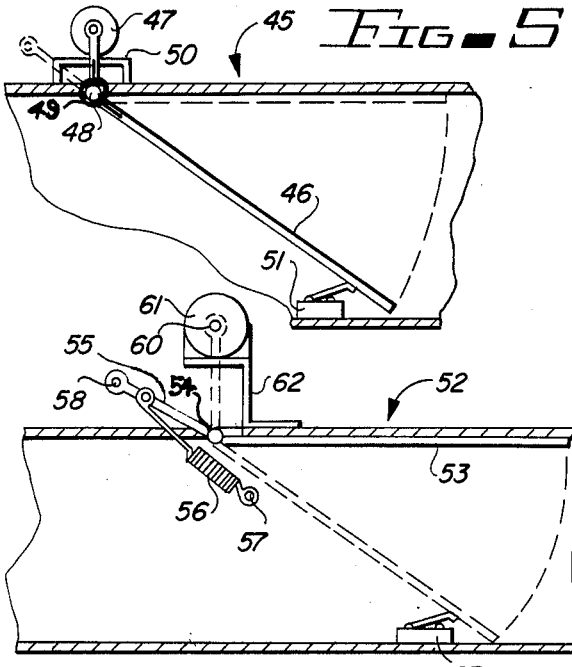
FIG. 5
FIG. 6
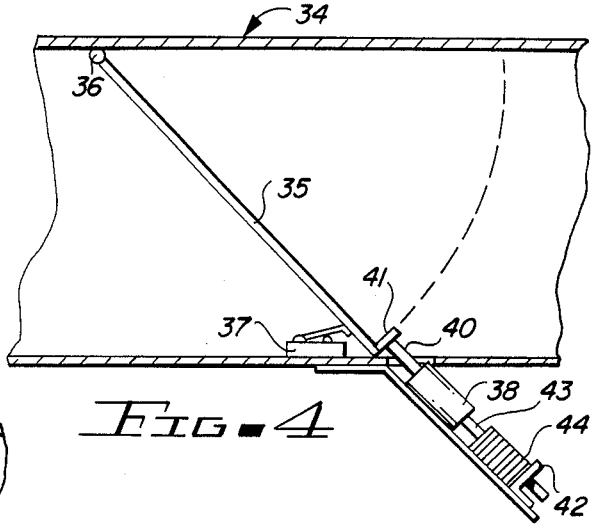
FIG. 4
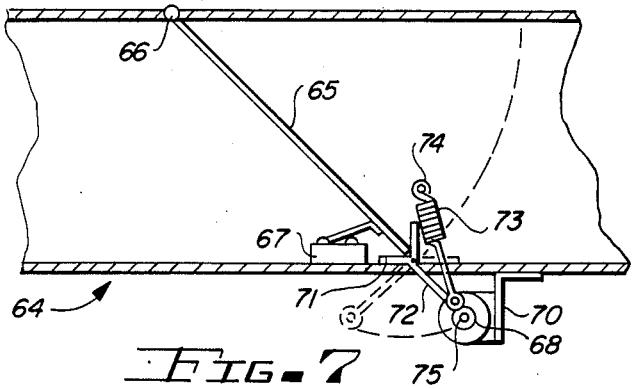
FIG. 7
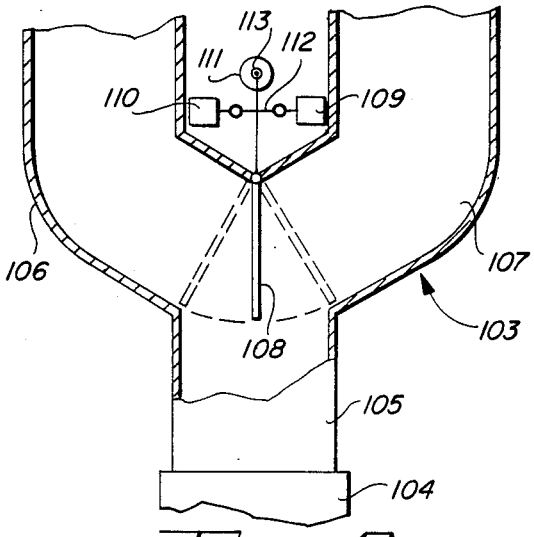
FIG. 8
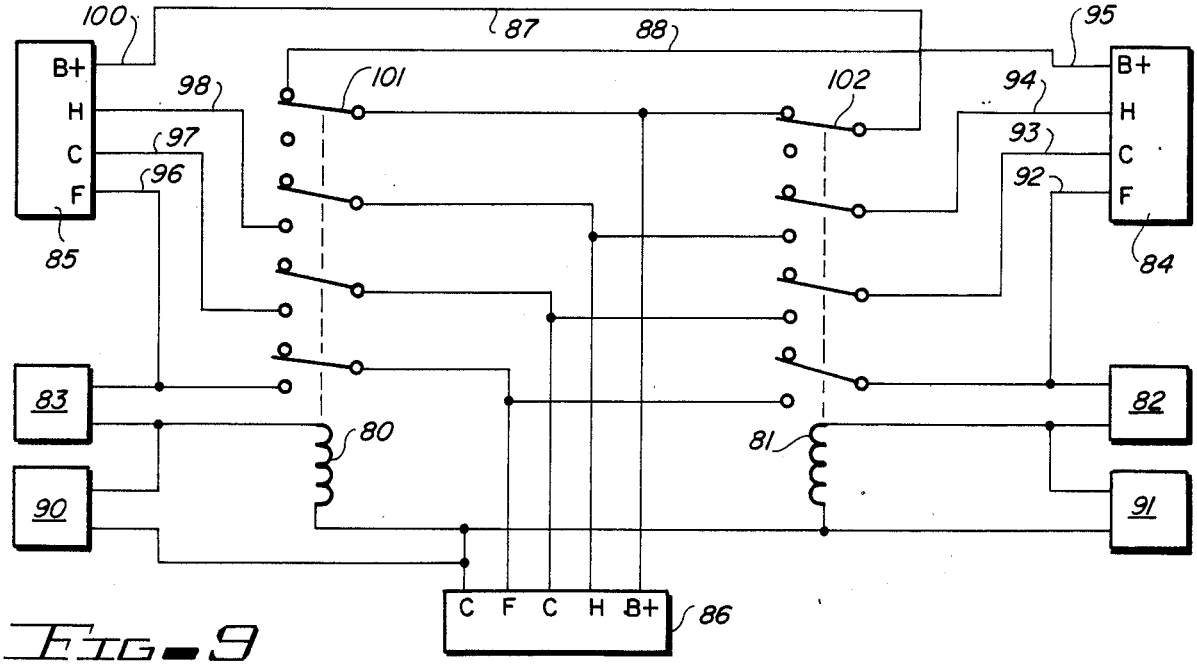
FIG. 9

ZONED HEATING AND AIR CONDITIONING SYSTEM

BACKGROUND OF THE INVENTION

The present invention relates to a zoned heating and air conditioning system, and especially to an air handling system having special dampers used in connection with separate thermostats to heat or air condition one zone while disabling another.

In the past, there have been a number of systems suggested for controlling the temperature in different portions of a building with different thermostats or for disabling one portion of a building when that portion of the building is not in use. Typically such systems use two air conditioning compressors along with two duct systems, one controlling the temperature in the bedroom portion of a house and the other controlling the temperature in the living room, dining room and kitchen portion of a house. In this way the bedroom portion can be heated or cooled in the evenings with the temperature adjusted during the daytime to reduce the energy usage in that portion of the house. Similarly, the remainder of the house can be adjusted between nighttime and daytime, and thereby reduce the total energy utilized. It has also been suggested to open or close air grills to disable one or more rooms for long periods of time so that energy is not wasted heating or cooling an unused room or portion of a house. One of the disadvantages of many prior systems is that they require two separate air conditioning systems, or alternatively, require expensive electrical systems for working different portions of the building. The present system overcomes some of the disadvantages of prior systems by providing a single heating and cooling system of a substantially reduced size for a building while maintaining the comfort level of those portions of the building in use. For instance, the heating and air conditioning system can be reduced in size to provide only half as much energy as required for the full building. The duct system would be similar in cost and complexity to an existing duct system with the building set up to operate the heating and air conditioning system only in that portion of the building in use at any particular time, and to shift from one system to the other prior to using the other part of the building. The present system also provides for inexpensive dampers electronically controlled to reduce the cost of the system to well below the cost of a heating and air conditioning system for the entire building.

Typical prior art U.S. patents can be seen in the Perkins U.S. Pat. No. 3,994,335, for a multizone air conditioning system using a thermostatically controlled valve system in the air ducts to control the amount of hot and cold air delivered to each zone of the building. Similarly, the Marshall, et al., U.S. Pat. No. 3,368,752, uses a spool valve to control cool air and the mix of cool and hot air in a dual duct air conditioning system with seasonal changeover assembly. Prior air conditioning grill dampers and air duct control systems can be seen in the U.S. patent to Waeldner, U.S. Pat. No. 3,604,625, on an air flow mixing device for air conditioning systems using a solenoid controlled system of interconnected valve members, and in the Downes, Jr., U.S. Pat. No. 4,418,719, for an air control apparatus using a drive motor to shift vanes. The Marks, et al., U.S. Pat. No. 4,055,954, shows a damper actuator for ventilator systems in which a temperature expansion cylinder is used for controlling the damper. The Felter patent, U.S. Pat. No. 4,017,026, is for an automatic damper which has a temperature responsive element for pivoting semicircular vanes. The Maxson patent, U.S. Pat. No. 4,397,223, is an air distributor with automatically closing dampers and the Waterfill patent, U.S. Pat. No. 2,999,640, is an air conditioning mixing valve in which the air flowing past the pipe is aspirated to adjust the valve with a negative pressure in a shifting valve system.

In contrast to these prior patents, the present invention is directed towards a centrally controlled system which will operate dampers in combination with the controls to maintain the temperature in one zone of a building while shutting off another zone of a building and requiring a less expensive installation and a reduced use of energy in the building.

SUMMARY OF THE INVENTION

The present invention relates to a zoned heating and air conditioning system having an air handling system with an air blower connected to an air duct system in a building. At least two thermostats are positioned in different portions of the building and interconnected for actuation of only one zone of a building at one time. A plurality of dampers are positioned in the air duct system of the building with each damper being adapted to be opened and closed by gravity or air pressure, and each damper having a locking means for locking each damper in a closed position responsive to actuation by an electric switch. Each thermostat may be positioned to actuate one set of dampers with the operative thermostat actuating the inoperative thermostat's zone dampers. The dampers can be opened or closed by air pressure and can be opened or closed by gravity, but are locked in their closed position with a solenoid locking mechanism to block the flow of air to one zone of the building. Individual dampers can also be actuated by a simple electrical switch. Each damper may have a relay and a power supply for individually operating the solenoid with the locking mechanism with a low voltage system. The solenoids are used only for locking and may be spring loaded to reduce the amount of energy to operate the locks. The locks can be operated by using a larger power supply for the operation of the low voltage thermostat. Microswitches can be utilized to sense and activate or deactivate the solenoids only upon the damper being positioned in the proper location for locking.

BRIEF DESCRIPTION OF THE DRAWINGS

Other objects, features and advantages of the present invention will be apparent from the written description and the drawings in which:

FIG. 4 is a sectional view of another embodiment of a locking damper;

FIG. 5 is a sectional view of another embodiment of a locking damper;

FIG. 6 is a sectional view of another embodiment of a locking damper;

FIG. 7 is a sectional view of another embodiment of a locking damper;

FIG. 8 is a sectional view of another embodiment of the locking damper; and

FIG. 9 is an electrical schematic of a two-zoned system in accordance with the present invention.

DESCRIPTION OF THE PREFERRED EMBODIMENTS

Figure 1:
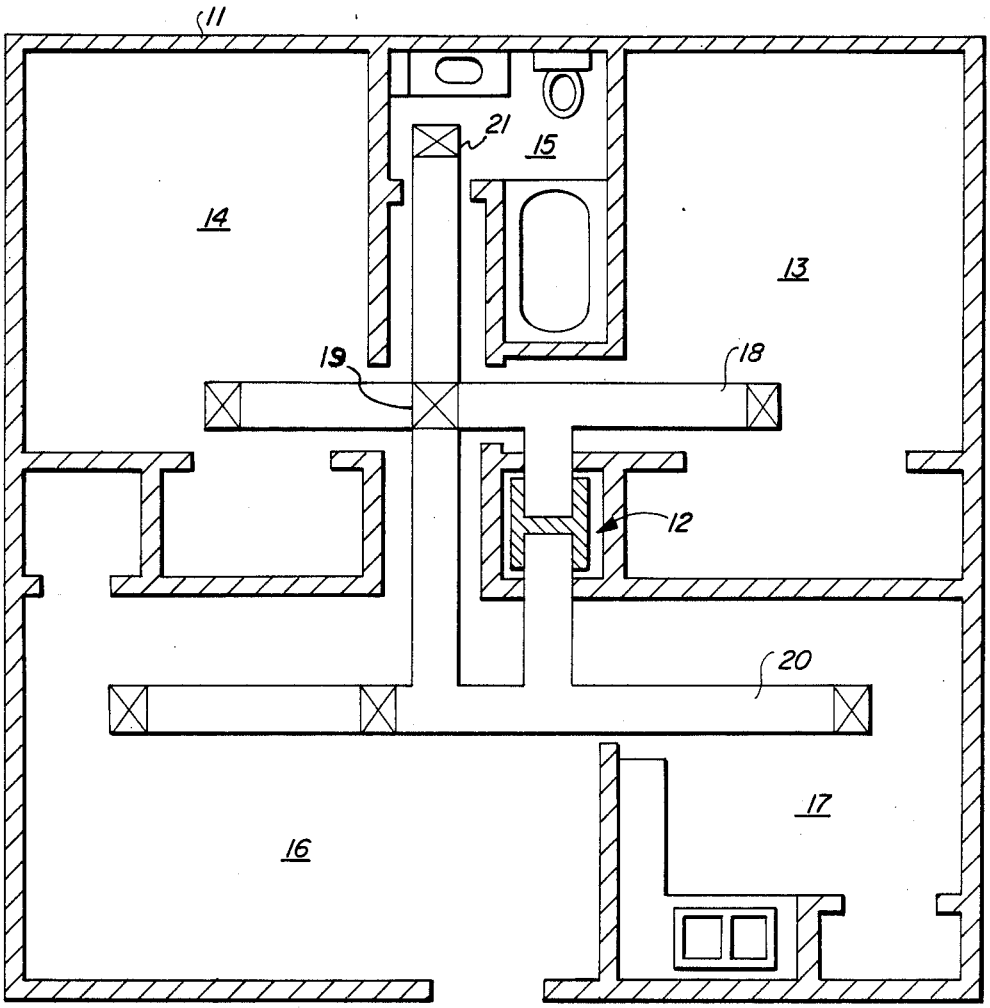
FIG. 1 is a layout of a duct system for a two-zone house.

Referring to FIG. 1 of the drawings, a building has exterior walls 11 with a central air handling system 12 located in the middle of the building or any other location and includes a pair of bedrooms 13 and 14 along with a bathroom 15 located between the bedrooms. A living room 16 is adjacent to a kitchen 17. A first zoned ducting system 18 is connected from the air handling system 12 to the bedrooms 13 and 14 and bathroom 15. A second air handling duct system 20 is connected to the central air handling system 12 and has outlets in the kitchen 17 and living room 16, as well as a connection to the bathroom 15. Bathroom 15 also has a common duct outlet at 21 which allows the duct system 18 or 20 to both operate in the bathroom 15 and through damper 19.

Figure 2:
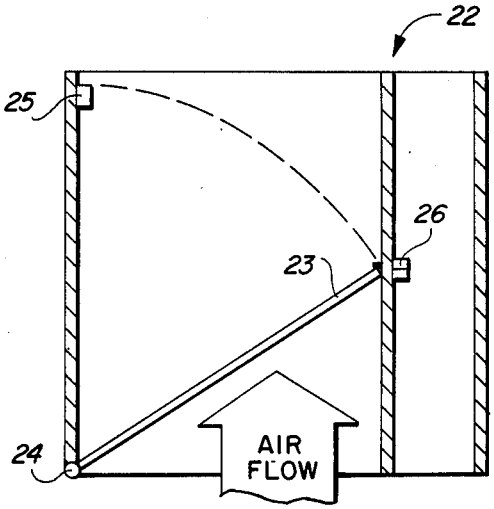
FIG. 2 shows a sectional view of a locking damper in accordance with the present invention locked in closed position.
Figure 3:
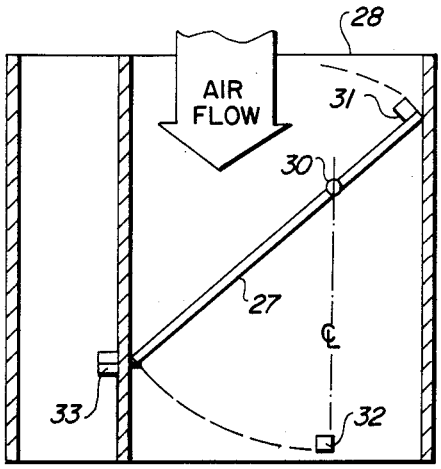
FIG. 3 is a sectional view of a second locking damper.

FIGS. 2 through 7 show various embodiments of locking dampers, but each of the locking dampers has several features in common including being moved from an open to closed position by either gravity or by the force of the air flow and each can be left in a locked position to close off a duct or to close off one duct while opening a second one. The embodiment in FIG. 2 shows a duct 22 having a damper door 23 therein pivoted at 24 and pushed by the air against a damper stop 25. The damper in this case is closed by gravity and locked by a damper solenoid lock 26 (shown schematically but which may operate in accordance with FIG. 4) positioned in the control compartment between two dampers. Similarly, FIG. 3 has a damper 27 in a duct 28 pivoted on a pivot point 30 located in the duct and has a counterweight 31 on one end to counterbalance the damper door 27. A damper stop 32 catches one end of the door 27 when open while the solenoid lock 33 (shown schematically but which may operate in accordance with FIG. 4) locks the damper door 27 when the counterweight 31 swings the door 27 against the lock 33 when there is no air flowing. When the lock 33 is released, the air flow will force the door 27 against the damper stop 32 and hold the door open as long as air is flowing thereby. Turning to FIG. 4, additional detail is shown of a damper in a duct 34 having a damper door 35 pivoted on a hinge 36 from an open position where air can flow through the duct system to a closed position as shown in this view in which the damper door 35 has a microswitch 37 to actuate or tell the solenoid 38 that the door 35 is in position for locking. Switch 37 is always supplied with power and is wired to solenoid 38 so that when the door 35 opens, power is supplied to the solenoid by the switch 37 and this circuit is connected in parallel with the circuit supplying energy from the zone thermostats 90 and 91 of FIG. 9. The solenoid 38 has a plunger 40 which slides into position with a locking tip 41 to lock the damper door 35 in position to block the flow of air past the damper. Solenoid 38 has an adjustable frame 42 for the back portion of the plunger 43 and has a spring 44 mounted around the plunger 43 which holds the plunger 40 in a normally locked position.

FIG. 5 shows another locking damper door in an air handling duct 45 having a locking damper door 46 attached to a solenoid motor 47 with a hinge pin 48 through a locking arm 50. Solenoid 47 is actuated upon the microswitch 51 generating a signal to actuate the solenoid 47. A spring 49 is wrapped around the hinge pin 48 to slightly bias the door to leave a small opening for the passage of air when the door 46 is closed.

FIG. 6 shows another embodiment in which a duct 52 for the handling of air has a damper door 53 in its open position as shown connecting by a hinge pin 54 to a locking arm 55 which is spring actuated by a spring 56 pinned at 57. The locking arm 55 has an aperture 58 therein and is aligned with the plunger 60 of the solenoid 61 attached to a solenoid support bracket 62 when the door is closed. Solenoid 61 is actuated when the damper door 53 bumps against the microswitch 63 which is thereby actuated to drive the plunger arm 60 through the aperture 58 to lock the solenoid door in place. The damper door 53 is held in an open position by the spring 56 and air flow until the reduced flow of air allows the door 53 to fall to the closed position where the spring 56 helps close door 53 to hit the microswitch 63.

Similarly, the embodiment shown in FIG. 7 in the air duct 64 has a damper door 65 hinged with a hinge 66 which can swing from an open duct position to a closed duct position, where it hits a microswitch 67 which actuates a solenoid 68 attached to a solenoid bracket 70. The swinging of the gate 65 engages a bifurcated leg 71 in a locking arm 72 pivoting at (x) which is spring loaded by spring 73 pinned to the ducts at 74 to align an aperture 75 on the arm 72 with a solenoid 68 to lock the solenoid plunger in the aperture 75 of the arm 72 when the damper door 65 abuts the microswitch 67. The advantages of these damper control systems is that the dampers are controlled either by gravity or the flow of air and are locked in position using a minimum of electrical energy and thus may use a low voltage system operated by the same voltage to drive the thermostats to reduce the cost and complexity of the electrical control system.

Turning to FIG. 8, a damper door is mounted in a dividing duct 103 and allows for the air to enter from the duct 104 through the duct 105 into the dividing ducts 106 and 107. The Y-duct 103 has the damper door 108 pivoted on the bottom of the bifurcated portion. The damper door is connected between solenoids 109 and 110, through a linkage 112 to position the door for solenoid 111 to extend the solenoid plunger through the opening 113, to lock the damper door 108 directly centered in the duct 105 between the ducts 106 and 107. The air in duct 105 is thus evenly divided between ducts 106 and 107 when the duct is locked in position. Actuating the solenoids 109 and 110 and releasing the solenoid 111 can move the damper door 108 to the right or to the left to block off either duct 106 or 107. The air pressure entering the duct 105 will maintain the damper door 108 in the closed position. Alternatively the door can be locked with latching solenoids 109 and 110. It should also be clear in this embodiment that the air can be received from the dividing ducts 106 and 107 into the duct 105, as desired, without departing from the spirit and scope of the invention.

FIG. 9 is a schematic diagram of a two-thermostat, two zone building heating and cooling system having a four-pole relay 80 and a four-pole relay 81. Relay 81 is connected through a time-delay circuit 82 to the fan connection of the thermostat 84, while the relay 80 is connected through a time delay circuit 83 through a fan connection of a thermostat 85. Thermostat 84 and thermostat 85 are connected through the relays 80 and 81 to the air handling system 86 which may include a heat pump or a heating furnace and air conditioning combined along with the air blower. The fan lines 92 and 96 from the thermostats 84 and 85 to the air handlers are connected through damper controls 90 and 91 in parallel to the relays 80 and 81 but in series with the time delay circuits 82 and 83. This allows the damper controls to lock the dampers after a predetermined time delay, when the circuit is actuated. The circuit is actuated by a voltage between the fan connection on the air handler unit 86 and the fan connection on either the thermostat 84 or the thermostat 85. The unit is designed so that only one thermostat can be connected to the air handler at one time. This thermostat 84 has air handling connection lines 92 which is connected to actuate the fan as well as lines 93 and 94 for actuating the heating and cooling, and a primary voltage line 95. The thermostat 85 has the fan line 96 as well as a cooling line 97 heating line 98 and a primary voltage line 100. The primary voltage line of the thermostat 84 is connected through the relay 80 and has one contact 101 closed or connected in the relay's normally closed position while the remaining contacts are oppositely connected to connect the thermostat 85 to the air handler 86 when the relay 80 is actuated disengaging the contact 101 and the thermostat 84 from the primary voltage source. Similarly, the thermostat 85 has a primary voltage source line 87 connected across a relay contact 102 which is a normally closed position while the remaining contacts of relay 81 are normally open so that actuation of the relay 81 will disengage the contact 102 but engage the remaining contacts for the lines 92, 93 and 94. In the normally closed position, contact 102 connects the voltage line from the air handler 86 to the thermostat 85. In operation, the air handler voltage is normally connected to both thermostats 84 and 85 until one is actuated, in which case its relay disengages the voltage to the other thermostat so that only one thermostat can be actuated at one time, and each thermostat can be actuated at different temperatures for controlling different portions of a building. Each thermostat's relay actuates the damper controls of the opposite thermostat's area of control to thereby close the dampers in the opposite thermostat's area, while one thermostat is in operation, so that the thermostats are controlling both sections of a building simultaneously at different temperatures. This handles a situation where one portion of a building has different temperature requirements from another. It also allows the thermostats to be manually set for turning portions of a building off and portions on during different times of the day or the year, and alternatively, the thermostats 84 and 85 can have commercially available timing thermostats for actuating the thermostats to an enabling position only at certain times of the day to thereby allow portions of the building to be turned on and off in accordance with the usage requirements of the portions of the building.

In the system shown in FIG. 1, This electrical circuit that can be used to control air handling in ducts 20 to the living room 16, the kitchen 17 and to the common bathroom 15 and ducts 18 to the bedrooms 13 and 14 and common bathroom 15 is located at the central air handling system 12. This system requires only the switching of one of a pair of dampers by one of the thermostats located in one of the bedrooms or one located in or near the living room. Thus, with the use of two automatic dampers actuated by either gravity or air flow and unlocked by small, low-voltage solenoids, a two-zone air handling system can be installed in a home or commercial building with two thermostats. A system in a residence or office like this allows a much smaller furnace and air conditioning compressor to be utilized, as well as smaller air handling system, and thus reduces the cost over the normal central heating-cooling system installation and substantially reduces the power requirement for the building.

Accordingly, the present invention is not to be construed as limited to the forms shown which are to be considered illustrative rather than restrictive.

I claim:

1. A zoned heating and air conditioning system comprising: a central air handling system having an air heating means and an air cooling means and a blower connected to an air duct system;

a plurality of thermostats each having heating and cooling set points, respectively associated with and located in different zones of a building; a plurality of dampers respectively associated with each said building zone positioned in the air duct system, each damper having an open position allowing air into the respective zone from said duct system and a closed position;

relay means for connecting one thermostat to said air handling system upon a call for heating or cooling by said one thermostat and disconnecting all other thermostats therefrom by connecting said one thermostat's connections between the thermostat and said air handling system whereby only one thermostat is connected to the air handling system at a time and said relay means disconnecting said one thermostat from said air handling system after said one thermostat is satisfied;

and damper actuating means for unlocking each damper in one building zone responsive to being actuated by a respective zone thermostat being connected to said air handling system by said relay means, said damper actuating means including a damper solenoid for each damper located adjacent each damper and connected to a respective zone thermostat to unlock each damper in one building zone responsive to being actuated by said respective zone thermostat and thereby unlock the dampers in one building zone zone when the one thermostat is actuated while preventing the dampers in another thermostat's building zone from unlocking.

2. A zoned heating and cooling system in accordance with claim 1 in which each damper includes a low-voltage solenoid lock means for locking the damper in a closed position.

3. A zoned heating and air conditioning system in accordance with claim 1 in which each damper is spring loaded and includes a microswitch positioned to be actuated by the damper in the closed position to deactuate a solenoid locking member.

* * * * *